United States Patent [19]

Rebold

[11] 4,161,289

[45] Jul. 17, 1979

[54] AIRBRUSH

[75] Inventor: Jerome I. Rebold, Timonium, Md.

[73] Assignee: CBS Inc., New York, N.Y.

[21] Appl. No.: 896,252

[22] Filed: Apr. 14, 1978

[51] Int. Cl.[2] ..... B05B 7/30

[52] U.S. Cl. ..... 239/346; 239/353; 239/377; 239/414; 239/526; 251/246

[58] Field of Search ..... 239/337, 338, 340, 345, 239/346, 353, 354, 369, 371, 375, 376, 378, 379, 409, 414, 415, 416.2, 416.4, 416.5, 417.3, 417.5, 423, 424, 526, 527; 222/193; 401/187-189; 251/224, 231, 235, 241, 243, 246, 263

[56] References Cited

U.S. PATENT DOCUMENTS

| | | | |
|---|---|---|---|
| 1,268,403 | 6/1918 | Stacker | 239/345 |
| 2,460,529 | 2/1949 | Paasche | 251/246 |
| 2,827,330 | 3/1958 | Brur | 239/415 |

*Primary Examiner*—Robert W. Saifer
*Assistant Examiner*—Andres Kashnikow
*Attorney, Agent, or Firm*—Spencer E. Olson

[57] ABSTRACT

An airbrush of the double action type has an elongated unitary body having an axial passage for longitudinal movement of a needle supported therein. The rear end of the needle is carried by a guide slidably supported in the axial passage and normally urged by a spring in a direction such that the tapered front of the needle enters and closes the jet. A finger-operated lever formed of plastic and shaped to provide a "living hinge" is supported in the body and arranged to engage the guide and move the needle against the action of the spring to control paint flow, and at the same time to open a valve to allow entry of compressed air or other substance under pressure. The maximum paint flow at the fully-operated position of the control lever is predetermined by adjusting the longitudinal position on the body of a closure cap which limits the movement of the guide. The airbrush has a minimum number of easily assembled parts and features a relatively simple paint-to-air seal disposed within the axial passageway.

10 Claims, 7 Drawing Figures

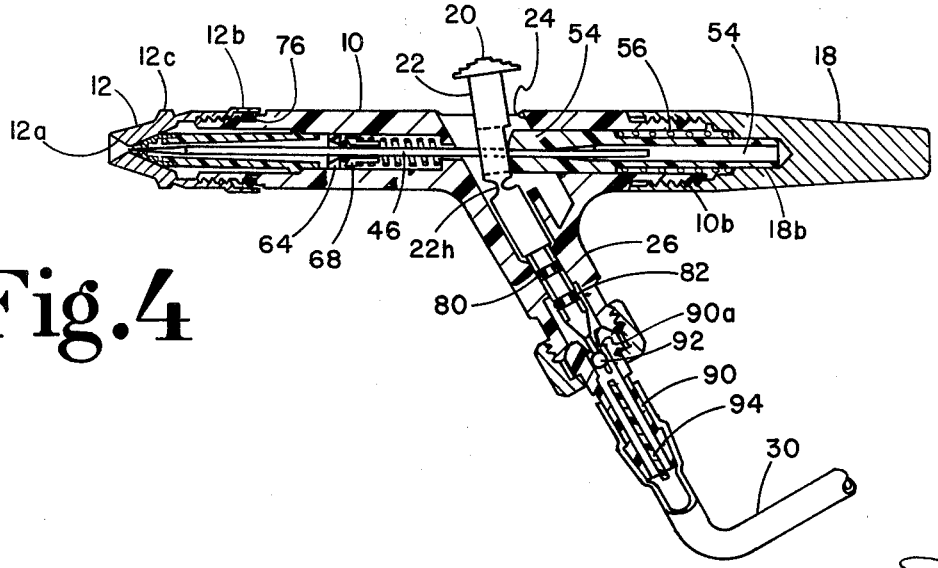
Fig.4
Fig.5
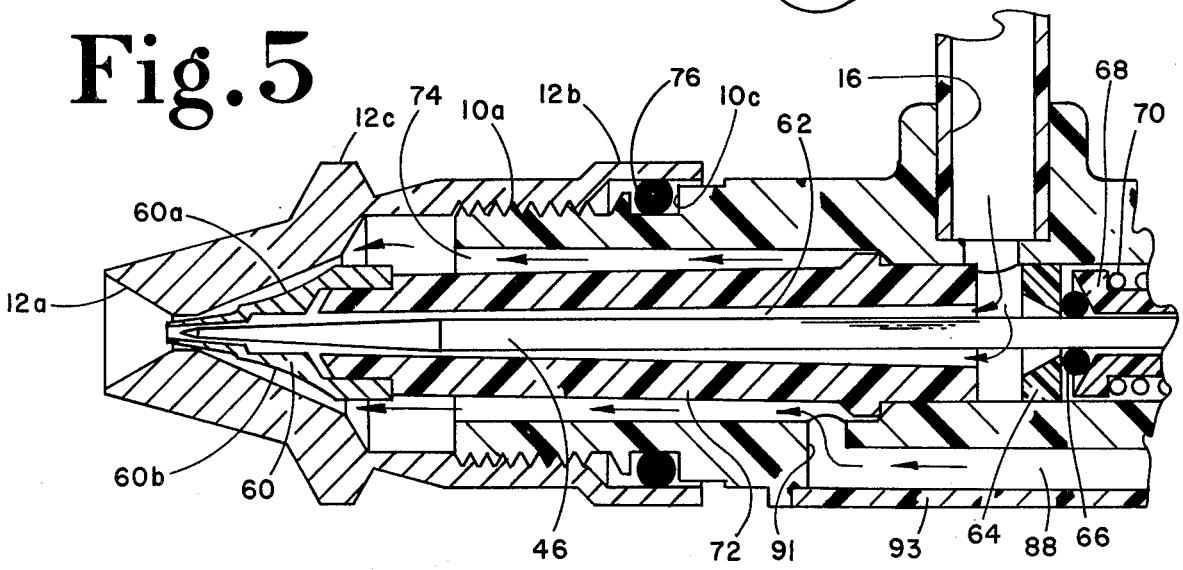
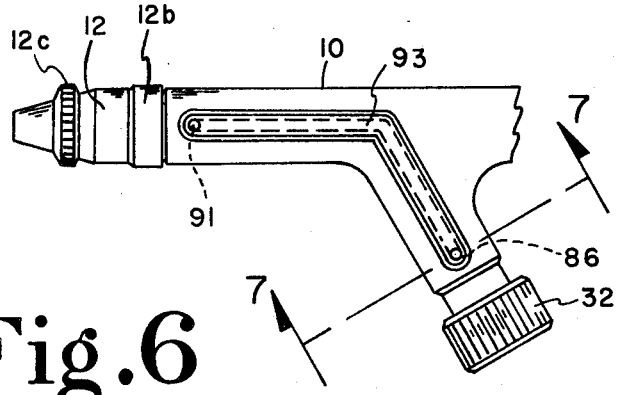
Fig.6
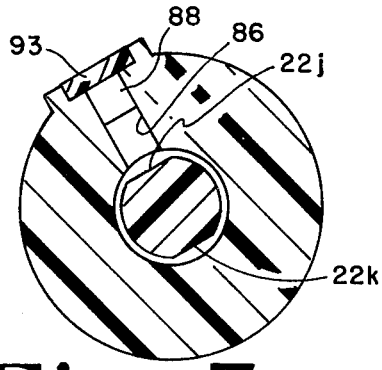
Fig. 7

AIRBRUSH

BACKGROUND OF THE INVENTION

The present invention relates to airbrushes, and more particularly to an improved airbrush of relatively small size such as is used by artists for fine or delicate work.

The prior art is replete with airbrushes of the type used by artists, photographers, designers, illustrators and others, many forms of which, covering a substantial range of quality and price, being commercially available. In airbrushes of this type it is desirable to provide, and most commercially available airbrushes do, for adjustment, repair and cleaning without the necessity of returning the airbrush to the factory. Thus, to facilitate servicing of the airbrush by the user, certain parts, particularly the needle and jet which control the supply of liquid or pigment to the brush, are made removable and replaceable. Most commercially available airbrushes also include some form of adjustable stop for controlling the needle valve when released so as to minimize shock and to increase the life of the needle and the valve seat. One form of such adjustable stop is described in U.S. Pat. No. 2,460,529 in an airbrush generally of the type to which the present invention pertains.

The object of the present invention is to provide an improved airbrush construction having a minimum of parts to enable it to be manufactured at relatively low cost, and having replaceable parts so arranged that proper positioning thereof is facilitated with minimum attention on the part of the person making the replacement or adjustment.

SUMMARY OF THE INVENTION

Briefly, the airbrush according to the invention is of the double-action type and has an elongated body having a passage for longitudinal movement of a needle supported therein. The rear end of the needle is carried by a guide slidably supported in the passage and normally urged forwardly by a spring such that the tapered front end of the needle seats in and closes the nozzle. A finger-operated lever formed of plastic and shaped to provide a "living hinge" is supported in the body and arranged to engage the guide and move the needle against the spring to control the amount of pigment flow and at the same time to open a valve to allow entry of air. The maximum paint flow at the fully-operated position of the control lever is predetermined by adjusting the longitudinal position on the rear end of the body of a closure cap which limits the rearward movement of the guide. The needle passes through and is guided by a relatively simple paint-to-air sealing structure contained within the longitudinal passage.

BRIEF DESCRIPTION OF THE DRAWINGS

Other objects, features and advantages of the invention will become apparent, and its construction and operation better understood, from the following detailed description, taken in conjuncton with the accompanying drawings, in which:

FIG. 4 is a longitudinal cross-sectional view of the airbrush of FIG. 1 shown in its operated position;

FIG. 5 is an enlargement of the left-hand portion of FIG. 4 taken along line 5—5 of FIG. 1;

FIG. 6 is a fragmentary elevation view of the left-hand portion of the airbrush as viewed in FIG. 1; and FIG. 7 is an enlarged cross-sectional view taken along the line 7—7 of FIG. 6.

DESCRIPTION OF THE PREFERRED EMBODIMENT

Figure 1:
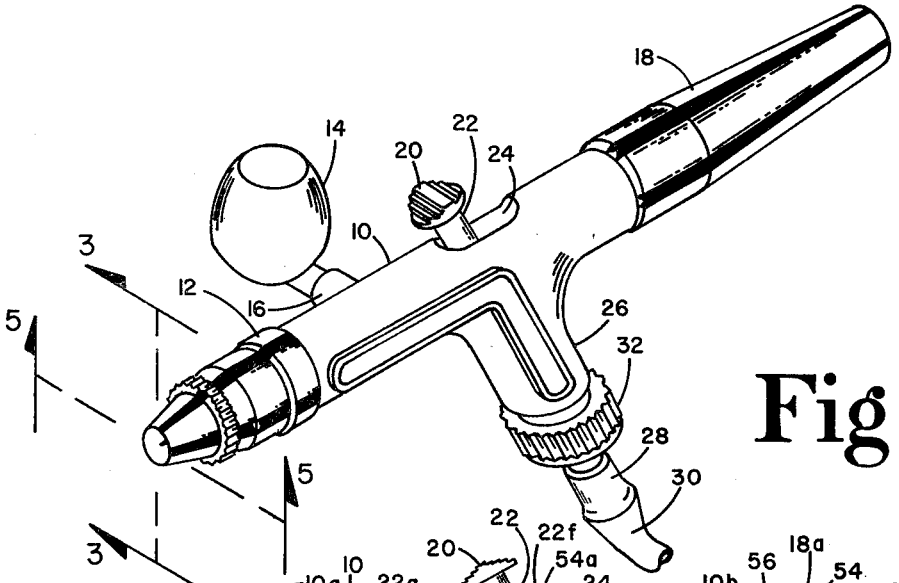
FIG. 1 is a perspective view of an airbrush according to the invention.

Referring to FIG. 1, the airbrush according to the invention includes a body member 10 having a generally cylindrical or elongated configuration tapered slightly at the forward end. An air cap 12 is threadedly secured to the forward end of the body, and a pigment cup 14 is positioned to one side of and communicates with the interior of the body. At the other end of the body 10 there is provided a longitudinally extending cap 18, preferably tapered as shown, threadedly secured to body 10. As will subsequently be seen, the longitudinal position of cap 18 on body 10 is adjustable and serves as a stop for the needle when the airbrush is in its operated position; thus, the amount of pigment delivered by the gun is controlled by adjusting the position of cap 18 on body 10. A finger button 20 located at the top of body 10 is integrally joined to a finger lever 22 which passes through a slot 24 to the interior of body 10. The finger lever 22 is formed of a suitable plastics material and is pivoted on a "living hinge" within body 10 so as to be movable rearwardly in slot 24 to cause rearward movement of the needle, and movable downwardly to open a valve contained in a cylindrical member 26 depending from an intermediate point of the body 10. Cylindrical member 26 terminates in a threaded portion for connection by a coupling means 28, which contains a ball valve actuable by depression of finger lever 20, to a hose or conduit 30 connectable to a source of air or other aeriform substance under pressure. The body 10 and the depending cylindrical portion 26 preferably is molded as a single part from a suitable plastic material, such as glass filled Delrin, complete with threads at both ends of body 10, and having a longitudinal passage for the needle and its associated guides and an internal passage communicating with slot 24 for receiving finger-operated lever 22. The internally threaded end caps 12 and 18 preferably are formed of metal, as is a knurled nut 32 provided to retain the coupling means 28 to the lower end of cylindrical portion 26.

Figure 2:
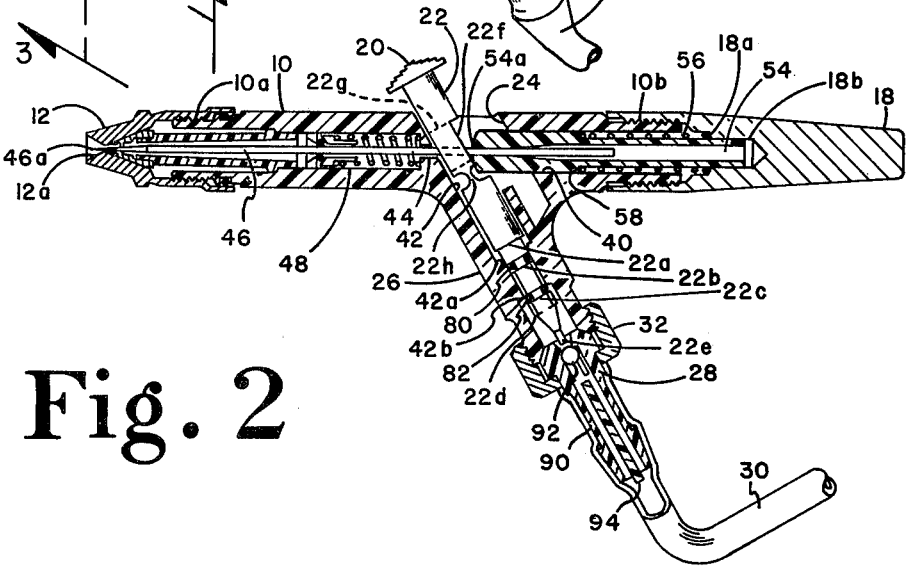
FIG. 2 is a longitudinal cross-sectional view of the airbrush of FIG. 1 shown in its normal un-operated condition.
Figure 3:
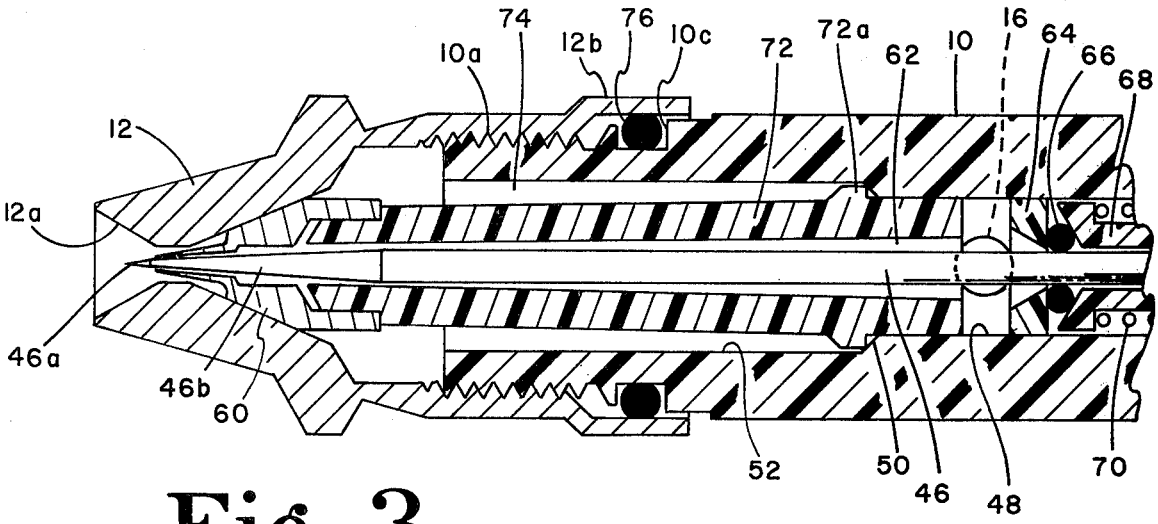
FIG. 3 is an enlargement of the left-hand portion of FIG. 2 taken along the line 3—3 of FIG. 1.

Referring more particularly to FIGS. 2 and 3, in which the airbrush is shown in its non-operated position, further details of the structure shown in FIG. 1 will become evident. The forward and rear portions of body 10 have threads at 10*a* and 10*b* to threadably receive air cap 12 and the tapered adjusting cap 18, respectively. Body 10 has a longitudinal bore 40 of uniform diameter extending forwardly from the rear end to an intermediate point of the body where it intersects a bore 42 in which the finger lever 22 is received. Just forwardly of finger lever 22, body 10 has a bore 44 of short length and a diameter to receive a needle 46 with a sliding fit, which serves as a guide for the needle. Forwardly of the bore 44 a cylindrical bore 48, of larger diameter than bore 44, extends to a shoulder 50 where the diameter is increased slightly to form a bore 52 that extends to the forward end of the body 10. The described bores of differing diameters provide cavities for the housing of certain elements required for the operation of the airbrush, as will now be described.

The cylindrical cavity defined by bore 40 encloses a cylindrical guide member 54 of uniform diameter for the rear portion of its length sufficiently smaller than the diameter of bore 40 to receive therearound a coiled compression spring 56, the forward end of which engages an abutment 58 formed by an increase in the diameter of the guide for the remainder of its length, which is dimensioned to provide a sliding fit within bore 40. The forward end 54*a* of the guide is generally hemispherical in shape, the reason for which will become apparent as the description proceeds. The rear end of needle 46 is received with a press fit in an axial opening formed in guide 54, which is formed of a suitable plastic material, such as Delrin. The guide 54 determines the longitudinal position of the needle, particularly the positioning of its point 46*a* relative to air cap 12 and a jet 60 supported within the cap at the forward end of the gun. In the non-operated condition shown in FIGS. 2 and 3, a circumferential abutment 18*a* on the interior surface of cap 18 engages spring 56 which, in turn, engages abutment 58 and urges the guide forwardly to cause point 46*a* of the needle to enter and completely close the opening in jet 60. It will be noted that in this condition the rear end of guide 54 is not bottomed in a cylindrical bore 18*b* formed in cap 18; the extent to which the guide can travel in the rearward direction before bottoming in bore 18*b* determines the amount the point 46*a* of needle 46 is retracted upon operation of the lever 22. Thus, adjustment of the longitudinal position of cap 18 on body 10 allows the user to preset the amount of paint flow through the nozzle. In contradistinction to the airbrush shown in the aforementioned patent, wherein a stop is provided to limit the forward travel of the needle upon a return or closing stroke, the present construction limits the rearward travel of the needle and causes the nozzle to be closed all the way when the finger-operated lever 22 is released. However, the compressibility of spring 56 precludes damage to the needle upon its return stroke into the jet, regardless of longitudinal position of cap 18 on the body.

A major portion of the cylindrical cavity defined by bore 48 is occupied by sealing means for preventing pigment or paint from entering the rear portion of the body 10 while at the same time permitting longitudinal movement of needle 46. As best seen in the cross-sectional view of FIG. 5, paint from pigment cup 14 enters through an opening 16 in the side of body 10 and fills the annular passageway 62 immediately surrounding needle 46, which passageway extends forwardly and into jet 60. A paint-to-air seal is provided adjacent to and rearwardly of the point of entry of the paint, and consists of an annular washer 64 formed of a suitable plastics material, such as Delrin, having an outer diameter to be received with a press fit in bore 48, an "O-ring" 66 formed of paint-resistant material, such as "Viton" rubber, having an inner diameter substantially equal to the outer diameter of needle 46, a bushing 68 dimensioned to slide freely within bore 48 and having a concave shaped end facing "O-ring" 66, and a compression spring 70 dimensioned to fit over bushing 68 and to urge it into engagement with "O-ring" 66. These parts are assembled in reverse to the order in which they are named, the washer 64 being jammed into bore 48 to secure the rest of the assembly in place. The spring 70, which is always in compression, exerts continuous pressure on bushing 68, which tends to compress the "O-ring" against washer 64 and needle 46, thereby to provide compensation for swell, shrinkage and wear of the involved parts.

Contained within the cavity defined by bore 52 is a hollow cylindrical tube 72 having an inner diameter sufficiently larger than the outer diameter of needle 46 to define with the needle the passage 62 for the paint, and an outer diameter sufficiently smaller than the diameter of bore 52 to define with the bore an annular passage 74 for the flow of air toward and over the jet 60 and out through the nozzle. The sleeve 72 preferably is formed by molding from a suitable plastics material, such as Delrin, and is slightly tapered, both inside and out, from back to front, so as to constrict the passage as it approaches jet 60 and to increase the volume of the air reservoir behind air cap 12. The rear portion of tube 72 has a diameter to be received with a sliding fit in bore 48, the extent of penetration being limited by a circumferential boss 72*a* which engages abutment 50. This construction prevents paint from entering the air passage 74 or air from entering the paint passage 62. The forward end of tube 72 is of reduced diameter and receives and supports thereon the jet 60, which preferably is formed of metal, such as brass. The cylindrical outer surface of the jet is tapered forwardly and engages a complementary tapered surface formed on the interior of air cap 12, which is also formed of metal; e.g., aluminum; thus, air cap 12 serves as a guide or pilot for jet 60 which, in turn, supports the forward end of sleeve 72 to maintain concentricity of sleeve 72 and needle 46 with cylindrical cavity 52. Although not visible in FIG. 3, but shown in FIG. 5, the tapered cylindrical surface of jet 60 has a pair of diametrically opposed flats 60*a* and 60*b* formed thereon to permit flow of air from passageway 74 between the jet and cap 12 and out to the flared nozzle 12*a* formed at the end of cap 12. The internal bore of jet 60 is tapered near its exit end to substantially conform with the taper of the needle 46 at its forward portion 46*b*, such that when the airbrush is in its non-operated condition, as shown in FIGS. 2 and 3, the complementary tapered surfaces of the needle and the bore of the jet close off the paint passageway 64, with only the point 46*a* of the needle projecting beyond the forward end of the jet. Air cap 12 is internally threaded to engage the threads 10*a* on body 10, and an "O-ring" 76 retained in a circumferential groove 10*c* formed in the outer wall of body 10 and engaged by the rear portion 12*b* of the cap provides an effective seal for the air passage 74. The cap preferably is knurled at 12*c* to facilitate its removal for access to the tip of the jet and needle for cleaning and replacement on the body.

The needle 46 is retracted from jet 60 a preset amount, and air or other aeriform substance under pressure enters air passageway 74, upon actuation of finger lever 22 which, as has been noted, is supported in cylindrical bore 42 formed within depending portion 26 of the body. The bore 42 communicates with slot 24 and extends downwardly to a point 42*a* at which the diameter is decreased somewhat to provide an air-sealing region, and at 42*b* the diameter of the bore is again increased and extends to the lower end of body portion 26.

Finger lever 22 is a unitary piece molded of a suitable plastics material, such as polypropylene, and is of generally cylindrical cross-section throughout its length, albeit various portions thereof have different diameters, for reasons now to be described. Starting at finger button 20 the lever has a first diameter, slightly smaller than the diameter of bore 42, to the point 22a at which the diameter is decreased to substantially that of bore 42 throughout the portion between points 42a and 42b, and except for a pair of circumferential grooves 22b and 22c for receiving and retaining "O-rings" 80 and 82, respectively, continues to have this diameter until at point 22d it is tapered down to a small diameter stem 22e, the purpose of which will shortly become evident. The lever has a flat 22f thereon facing the convex end surface 54a of guide 54, and in the region of this flat has a diametral slot 22g therethrough of sufficient width freely to receive needle 46. Immediately below flat 22f the lever is formed with cutouts extending in a direction transversely of needle 46 to provide at 22h a "living hinge"; that is, upon rearward movement of button 20, the portion of lever 22 above the "hinge" pivots at point 22h. In the non-operated position this upper portion is urged forwardly by spring 56 acting on guide 54, and when button 20 is depressed and moved rearwardly, the flat 22f engages convex surface 54a of the guide to urge it rearwardly against the action of spring 56, thereby to retract the tapered portion 46b of the needle from jet 60, the maximum retraction being determined by the longitudinal position of end cap 18 on body 10. It will be seen in FIG. 4 that in the fully retracted position, for a given position of cap 18, the rear end of guide 54 is bottomed in internal bore 18b of the cap; thus, the preadjusted position of cap 18 on body 10 determines the maximum rate of flow of pigment through jet 60.

By virtue of the convex surface 54a on the end of the guide and the spatial relationship between this surface and the flat 22f on lever 22, the point of contact between the flat and the convex surface moves upwardly as the lever is pulled back, thereby to change the ratio of the lever. This offers the advantage of finer, more sensitive, control at the start of pullback of the needle than at the rear end of the stroke; thus the control is greatest when the finest lines are being painted, and the percentage change in nozzle opening is substantially uniform as a function of rearward movement of lever 22, a feature lacking in commercially available airbrushes of which applicant is aware.

Ignoring for the moment retainer ring 32 and connector assembly 28, if a compressed air supply is coupled to the threaded lower end of portion 26 with a conventional fitting, lever 22 is forced upwardly by the air pressure causing lower "O-ring" 82 to engage the shoulder at 42b where the diameter of the bore is decreased. The upper "O-ring" 80 floats and engages the inner wall of the reduced diameter bore. If, now, the lever is urged downwardly against the air pressure, the seal between "O-ring" 82 and the shoulder at 42b is broken and air enters the region of the reduced-diameter bore between the two "O-rings". As best seen in the enlarged cross-sectional view of FIG. 7, stem 22 at this portion of its length has flats 22j and 22k formed thereon to allow air to flow around the lever for ultimate delivery to air passageway 74 within the body of the gun. As shown in FIGS. 6 and 7, in the region between "O-rings" 80 and 82 a hole 86 couples the reduced diameter bore to a groove 88 formed in the outer wall of body 10 and depending portion 26, which extends from hole 86 to a hole 91 in the wall of body 10 which, in turn, communicates with air passageway 74. The groove 88 is formed during molding of the body and then is covered by a closure strip 93 formed of suitable plastic ultrasonically welded over it to provide a closed conduit for air. The flats 22j and 22k are keyed to the needle-receiving slot 22f to ensure that when the lever 22 is assembled within depending portion 26 (which is accomplished simply by placing the "O-rings" 80 and 82 in their respective retaining grooves and inserting the lever from above) one of the flats faces the hole 86.

Reverting now to FIGS. 2 and 4, although as just described the threads at the lower end of depending protion 26 will accommodate a standard hose fitting, an important feature of the present airbrush is the provision of the connector assembly 28 which contains a self-sealing valve, and is secured to depending portion 26 by a threaded retainer ring 32. Connector assembly 28 includes a hollow cylindrical connector member 90 preferably formed by molding from a suitable plastics material, such as polypropylene or Delrin, the internal diameter of which is substantially uniform throughout most of its length; at its upper end the diameter is reduced to form a circumferential shoulder 90a and has an opening for the short remaining portion of its length slightly larger than the stem 22e on lever 22. A small ball 92, slightly smaller in diameter than the bore of connector 90 but larger than the opening, is retained for limited axial movement within the bore by a flat retainer member 94, also formed of a suitable plastics material, which may be the same as that from which connector 90 is formed, received with a press fit within and disposed along the diameter of the bore; thus there is a passage for air to enter on both sides of retainer 94. The outer cylindrical surface of connector 90 is shaped to firmly engage hose 30, normally formed of thin-walled, tough plastic tubing. The upper end of connector 90 is formed with an external shoulder 90b which is engaged by retainer ring 32 to releasably connect the connector assembly to the airbrush.

As illustrated in FIG. 2, with air under pressure in connecting hose 30, ball 92 is urged against shoulder 90a and prevents air from entering the airbrush. In the event any air should get past the ball, lower "O-ring" 82 will provide the necessary seal. When lever 22 is depressed, as shown in FIG. 4, the stem at the lower end thereof enters the opening in the connector and moves ball 92 away from shoulder 90a to allow air to enter. At the same time, lower "O-ring" 82 is disengaged from the sealing shoulder 42b so as to allow air to pass into hole 86 and groove 88. The described valve provides a quick disconnect feature in that retainer ring 32 can be disconnected from the airbrush without first closing a valve on the air supply, since the ball valve 92 serves to close off the hose 30 whenever it contains air under pressure.

It will be evident from the foregoing description that there is provided an airbrush of the "double-action" type having a minimum number of relatively inexpensive parts that are easily assembled. The design is such that essential dimensional inter-relationships are automatically preset in the assembly process, yet allows adjustment of maximum pigment flow by simple adjustment of end cap 18. The jet is closed in the non-operated condition thereby to minimize drying of paint in the nozzle region, and when cleaning is required, the air cap 12 and jet 60 can easily be removed from the body.

I claim:

1. An airbrush of the double-action type, comprising:

a unitary body including an elongated portion having forward and rearward ends and having an axial passage therein for a needle, and a cylindrical portion depending from an intermediate point of the elongated portion and having a passage intersecting the axial passage in said elongated portion for receiving a finger-operated lever, an internally tapered air cap threadably secured to the forward end of the elongated portion of said body, a jet supported within and in fixed spatial relationship with said air cap, a closure cap closing the rearward end of the elongated portion of said body adapted for longitudinal adjustment on said elongated portion and having an internal recess formed therein coaxially with said axial passage, a needle having a tapered forward end supported in said axial passage for longitudinal movement therein, said needle being guided at a point forwardly of said intermediate point by paint-to-air sealing means disposed within said axial passage and secured at its other end to and guided by an elongated guide member a forward portion of the length of which is supported within said axial passage for longitudinal movement therein and a rearward portion of the length of which extends into the recess in said closure cap, spring means cooperatively arranged with said closure cap and said guide member for normally biasing said needle to a position at which the tapered front end thereof is seated in said jet, and a finger-operated lever supported in the passage in said depending cylindrical portion to engage the forward end of the forward portion of said guide member for moving the needle against the action of said spring means, the extent of movement being limited by engagement of the rearward end of the rearward portion of said guide member with the bottom of the recess in said closure cap, whereby the maximum opening of the airbrush is predeterminable by the adjusted position of the closure cap on the elongated portion of said body.

2. An airbrush according to claim 1, further including a hollow tubular member removably supported within said axial passage forwardly of said paint-to-air sealing means and through which said needle extends, the inner surface of said tubular member and said needle defining an annular passage for paint, and wherein said jet is secured to the forward end of said hollow tubular member.

3. An airbrush according to claim 1 or claim 2, wherein said paint-to-air sealing means comprises in the order named in the direction toward the rearward end of the elongated portion of said body, an annular washer formed of paint-resistant material engaging said axial passage with a press fit, an "O-ring" formed of paint-resistant material having an inner diameter substantially equal to the outer diameter of said needle, an elongated bushing dimensioned to move freely within said axial passage, and spring means continuously biasing said bushing into engagement with said "O-ring".

4. An airbrush according to claim 1 or claim 2, wherein said finger-operated lever comprises a finger button disposed exteriorly of the elongated portion of said body integral with an elongated member formed of plastics material having a generally circular cross-section throughout a substantial portion of its length and having a diametral slot formed therein near said finger button for receiving said needle therethrough, said member having a reduced cross-sectional area at a point adjacent to and below said diametral slot forming a hinge about which the portion of the member thereabove may be pivoted toward the rearward end of the elongated portion of said body into engagement with the forward end of the forward portion of said guide member.

5. An airbrush according to claim 4, wherein the forward end of the forward portion of said guide member is of convex shape, and wherein the elongated member of said finger-operated lever has a flat surface substantially coextensive with said slot confronting the convex forward end of said guide member whereby the point of contact between the flat surface on said lever and the convex surface of said guide member moves upwardly as the lever is pivoted toward the rearward end of the elongated portion of said body, thereby to change the ratio of the lever as a function of its rearward motion.

6. An airbrush according to claim 5, wherein the lower end of said depending cylindrical portion is threaded to receive a fitting for connecting a source of air under pressure to said airbrush, and wherein the elongated member of said lever includes sealing means arranged to coact with the passage in said depending cylindrical portion to prevent entry of air into the airbrush when the finger-operated lever is in its normal position, and to allow air under pressure to enter the airbrush when the lever is pushed downwardly and pivoted rearwardly.

7. An airbrush according to claim 6, wherein said fitting comprises a self-sealing valve including a connector assembly having an opening therethrough normally sealed by a ball valve, and wherein the lower end of said finger-operated lever is dimensioned to unseat the ball valve when said lever is pushed downwardly.

8. An airbrush according to claim 2, wherein said unitary body, said hollow tubular member and said finger-operated lever are all fabricated from plastic material.

9. An airbrush according to claim 8, wherein the lower end of the depending portion of said body is threaded to receive a fitting for connecting a source of air under pressure to the airbrush, wherein said finger-operated lever includes sealing means for preventing entry of air into the airbrush when the lever is in its normal unoperated position and for allowing air under pressure to enter the airbrush when the lever is pushed downwardly, and wherein said body has formed therein near its outer surface a passage for air under pressure from the axial passage in said depending portion at a point between the threaded end thereof and said sealing means to the axial passage in said elongated portion at a point near the rearward end of said hollow tubular member.

10. An airbrush according to claim 9, wherein the elongated portion of said body has an opening extending through the outer wall thereof communicating with the annular passage surrounding said needle, and further including a paint cup supported in said opening.

* * * * *